US007695104B2

(12) United States Patent
Donaldson et al.

(10) Patent No.: US 7,695,104 B2
(45) **Date of Patent: *Apr. 13, 2010**

(54) SLOTTED SUBSTRATES AND METHODS AND SYSTEMS FOR FORMING SAME

(75) Inventors: Jeremy Donaldson, Corvallis, OR (US); Eric L. Nikkel, Philomath, OR (US); Jeffrey S. Obert, Corvallis, OR (US); Jeffrey R. Pollard, Corvallis, OR (US); Jeff Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 636 days.

This patent is subject to a terminal disclaimer.

(21) Appl. No.: 11/410,358

(22) Filed: Apr. 25, 2006

(65) Prior Publication Data

US 2006/0192815 A1 Aug. 31, 2006

Related U.S. Application Data

(60) Division of application No. 10/601,157, filed on Jun. 20, 2003, now Pat. No. 7,040,735, and a continuation of application No. 10/284,867, filed on Oct. 31, 2002, now Pat. No. 6,672,712.

(51) Int. Cl.
*B41J 2/135* (2006.01)

(52) U.S. Cl. ..... 347/44

(58) Field of Classification Search ..... 347/20, 347/44, 45, 65

See application file for complete search history.

(56) References Cited

U.S. PATENT DOCUMENTS 5,317,346 A 5/1994 Garcia
5,387,314 A 2/1995 Baughman et al.
5,519,423 A 5/1996 Moritz, III et al.
5,751,317 A 5/1998 Peeters et al.
5,980,017 A 11/1999 Sato
6,003,986 A 12/1999 Keefe
6,019,457 A 2/2000 Silverbrook
6,019,907 A 2/2000 Kawamura
6,039,437 A 3/2000 Tsujimoto
6,053,599 A 4/2000 Maeda
6,062,681 A 5/2000 Field et al.
6,093,330 A 7/2000 Chong et al.
6,109,744 A 8/2000 Nishimura
6,113,223 A 9/2000 Tanaka et al.
6,132,033 A 10/2000 Browning et al.
6,161,923 A 12/2000 Pidwerbecki et al.
6,199,980 B1 3/2001 Fisher et al.

(Continued)

FOREIGN PATENT DOCUMENTS

EP 0895866 3/2000

(Continued)

OTHER PUBLICATIONS

GB Search Report 0325180.8 dated Apr. 16, 2004.

*Primary Examiner*—An H Do

(57) ABSTRACT

Methods and systems for forming compound slots in a substrate are described. In one exemplary implementation, a structure contains a plurality of slots in a substrate. The structure also has a trench in the substrate contiguous with the plurality of slots to form a compound slot.

19 Claims, 7 Drawing Sheets

U.S. PATENT DOCUMENTS

| | | | |
|---|---|---|---|
| 6,224,197 | B1 | 5/2001 | Hirasawa et al. |
| 6,270,198 | B1 | 8/2001 | Ahn et al. |
| 6,273,557 | B1 | 8/2001 | Milligan et al. |
| 6,280,642 | B1 | 8/2001 | Ikeda et al. |
| 6,299,673 | B1 | 10/2001 | Field et al. |
| 6,310,639 | B1 | 10/2001 | Kawamura et al. |
| 6,331,055 | B1 | 12/2001 | Miller et al. |
| 6,555,480 | B2 | 4/2003 | Milligan et al. |
| 6,666,546 | B1 | 12/2003 | Buswell et al. |
| 6,745,469 | B1 | 6/2004 | Soik et al. |
| 6,753,638 | B2 | 6/2004 | Adams et al. |
| 6,942,814 | B2 | 9/2005 | Wood et al. |
| 2001/0003460 | A1 | 6/2001 | Yoshihira et al. |

FOREIGN PATENT DOCUMENTS

| | | |
|---|---|---|
| GB | 2384751 | 8/2003 |
| GB | 2393147 | 3/2004 |
| JP | 2001-58404 | 3/2001 |

SLOTTED SUBSTRATES AND METHODS AND SYSTEMS FOR FORMING SAME

RELATED CASES

This patent application is a divisional claiming priority from a patent application having Ser. No. 10/601,157 titled "Slotted Substrates and Methods and Systems for Forming Same" filed Jun. 20, 2003 and issued as U.S. Pat. No. 7,040,735, which is entirely incorporated herein by reference and is a continuation of a patent application having Ser. No. 10/284,867 titled "Slotted Substrates and Methods and Systems for Forming Same" filed Oct. 31, 2002 and issued as U.S. Pat. No. 6,672,712 which is entirely incorporated herein by reference.

BACKGROUND

Inkjet printers and other printing devices have become ubiquitous in society. These printing devices can utilize a slotted substrate to deliver ink in the printing process. Such printing devices can provide many desirable characteristics at an affordable price. However, the desire for more features and lower prices continues to press manufacturers to improve efficiencies. Consumers want, among other things, higher print image resolution, realistic colors, and increased pages or printing per minute. Accordingly, the present invention relates to slotted substrates.

BRIEF DESCRIPTION OF THE DRAWINGS

The same components are used throughout the drawings to reference like features and components.

DETAILED DESCRIPTION

Overview

The embodiments described below pertain to methods and systems for forming slots in a substrate. Several embodiments of this process will be described in the context of forming fluid-feed slots in a substrate that can be incorporated into a print head die or other fluid ejecting device.

As commonly used in print head dies, the substrate can comprise a semiconductor substrate that can have microelectronics incorporated within, deposited over, and/or supported by the substrate on a thin-film surface that can be opposite a back surface or backside. The fluid-feed slot(s) can allow fluid, commonly ink, to be supplied from an ink supply or reservoir to fluid ejecting elements contained in ejection chambers within the print head.

In some embodiments, this can be accomplished by connecting the fluid-feed slot to one or more ink feed passageways, each of which can supply an individual ejection chamber. The fluid ejecting elements commonly comprise piezoelectric crystals or heating elements such as firing resistors that energize fluid causing increased pressure in the ejection chamber. A portion of that fluid can be ejected through a firing nozzle with the ejected fluid being replaced by fluid from the fluid-feed slot. Bubbles can, among other origins, be formed in the ink as a byproduct of the ejection process. If the bubbles accumulate in the fluid-feed slot they can occlude ink flow to some or all of the ejection chambers and cause the print head to malfunction.

In one embodiment, the fluid-feed slots can comprise compound slots where the compound slot comprises a trench and multiple slots or holes. The trench can be formed in the substrate and connected to the multiple slots or holes formed into the substrate. The holes of the compound slot can receive ink from an ink supply and provide ink to the trench that can supply the various ink ejection chambers. The compound slots can be configured to reduce bubble accumulation and/or promote bubbles to migrate out of the compound slot.

The compound slot can allow the substrate to remain much stronger than a similarly sized traditional slot since substrate material extends between the various slots and increases substrate strength. This configuration can be scalable to form a compound slot of any practical length.

Exemplary Printer System

Figure 1:
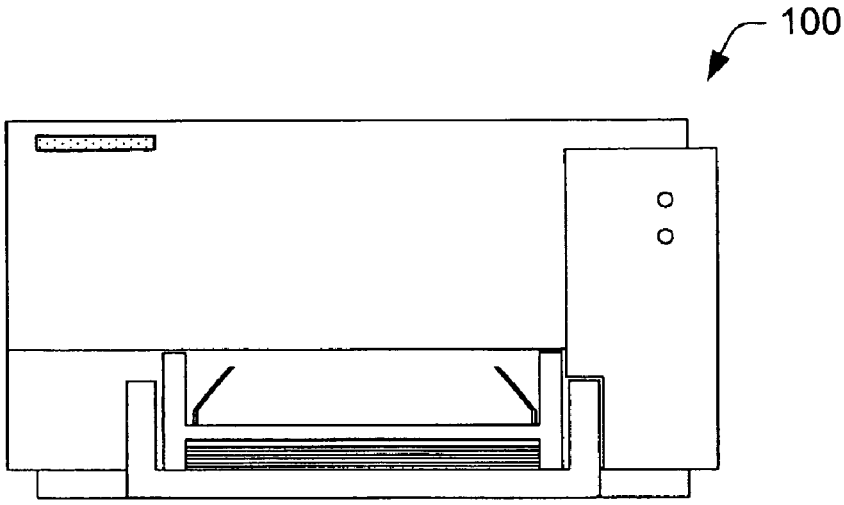
FIG. 1 shows a front elevational view of an exemplary printer.

FIG. 1 shows an exemplary printing device that can utilize an exemplary slotted substrate. In this embodiment, the printing device comprises a printer 100. The printer shown here is embodied in the form of an inkjet printer. The printer can be, but need not be, representative of an inkjet printer series manufactured by the Hewlett-Packard Company under the trademark "DeskJet". The printer 100 can be capable of printing in black-and-white and/or in black-and-white as well as color. The term "printing device" refers to any type of printing device and/or image forming device that employs slotted substrate(s) to achieve at least a portion of its functionality. Examples of such printing devices can include, but are not limited to, printers, facsimile machines, photocopiers, and other fluid ejecting devices.

Figure 2:
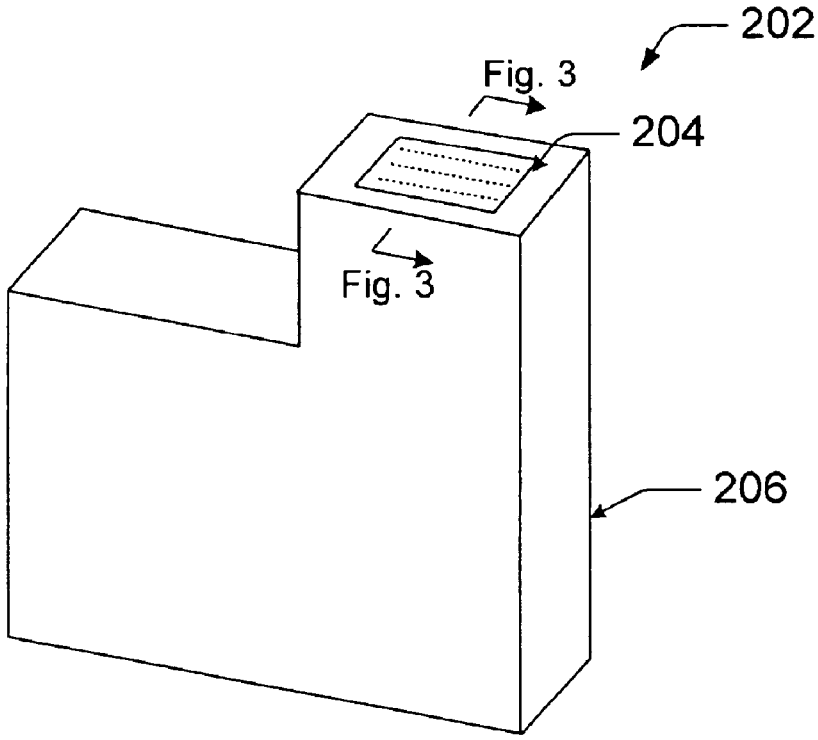
FIG. 2 shows a perspective view of an exemplary print cartridge in accordance with one embodiment.

FIG. 2 shows an exemplary print cartridge 202 that can be used in an exemplary printing device such as printer 100. The print cartridge 202 is comprised of the print head 204 and the cartridge body 206. Other exemplary configurations will be recognized by those of skill in the art.

Figure 3:
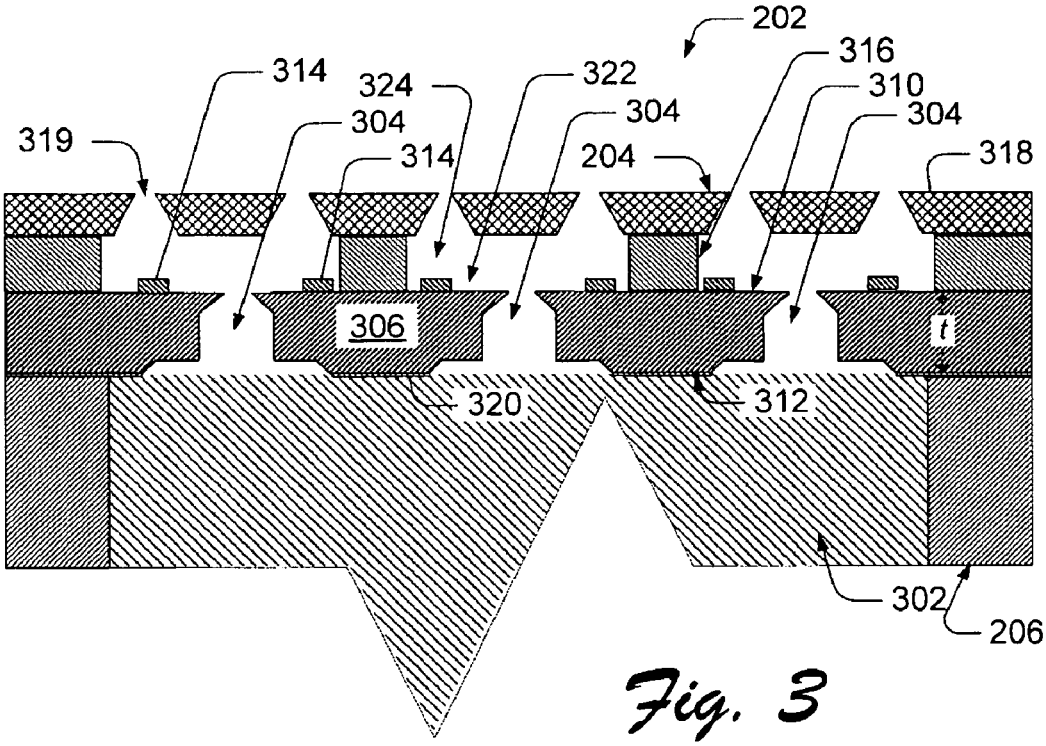
FIG. 3 shows a cross-sectional view of a top portion of an exemplary print cartridge in accordance with one embodiment.

FIG. 3 shows a cross-sectional representation of a portion of the exemplary print cartridge 202 as shown in FIG. 2. FIG. 3 shows the cartridge body 206 containing fluid 302 for supply to the print head 204. In this embodiment, the print cartridge is configured to supply one color of fluid or ink to the print head. In other embodiments, as described above, other exemplary print cartridges can supply multiple colors and/or black ink to a single print head.

Other printing devices can utilize multiple print cartridges each of which can supply a single color or black ink. In this embodiment, a number of different fluid-feed slots 304 are provided. In this embodiment, the fluid-feed slots 304 are compound slots as will be described in more detail below in relation to FIGS. 4-12.

Alternatively or additionally to the configuration shown in FIG. 3, other exemplary embodiments can divide the fluid supply so that each of the three fluid-feed slots 304 receives a separate fluid supply. Other exemplary print heads can utilize less or more slots than the three shown here.

The fluid-feed slots 304 pass through portions of a substrate 306. In this exemplary embodiment, silicon can be a suitable substrate. In some embodiments, substrate 306 comprises a crystalline substrate such as monocrystalline silicon. Examples of other suitable substrates include, among others, gallium arsenide, glass, silica, ceramics, or a semi-conducting material. The substrate can comprise various configurations as will be recognized by one of skill in the art.

The substrate 306 has a first surface 310 separated by a thickness t from a second surface 312. The described embodiments can work satisfactorily with various thicknesses of substrate. For example, in some embodiments, the thickness t can range from less than about 100 microns to at least about 2000 microns. Other exemplary embodiments can be outside of this range. The thickness t of the substrate in one exemplary embodiment can be about 675 microns.

As shown in FIG. 3, the print head 204 further comprises independently controllable fluid drop generators positioned over the substrate 306. In some embodiments, the fluid drop generators comprise firing resistors 314. In this exemplary embodiment, the firing resistors 314 are part of a stack of thin film layers positioned over the substrate's first surface 310. For this reason, the first surface is often referred to as the thin-film side or thin-film surface. The thin film layers can further comprise a barrier layer 316.

The barrier layer 316 can comprise, among other things, a photo-resist polymer substrate. In some embodiments, above the barrier layer is an orifice plate 318. In one embodiment, the orifice plate comprises a nickel substrate. In another embodiment, the orifice plate is the same material as the barrier layer. The orifice plate can have a plurality of nozzles 319 through which fluid heated by the various firing resistors 314 can be ejected for printing on a print media (not shown). The various layers can be formed, deposited, or attached upon the preceding layers. The configuration given here is but one possible configuration. For example, in an alternative embodiment, the orifice plate and barrier layer are integral. The substrate can also have layers, such as a hard mask 320, positioned on or over some or all of the backside surface 312.

The exemplary print cartridge shown in FIGS. 2 and 3 is upside down from the common orientation during usage. When positioned for use, fluid can flow from the cartridge body 206 into one or more of the slots 304. From the slots, the fluid can travel through a fluid-feed passageway 322 that leads to an ejection or firing chamber 324 that can be defined, at least in part, by the barrier layer 316. An ejection chamber can be comprised of a firing resistor 314, a nozzle 319, and a given volume of space therein. Other configurations are also possible.

Figure 4:
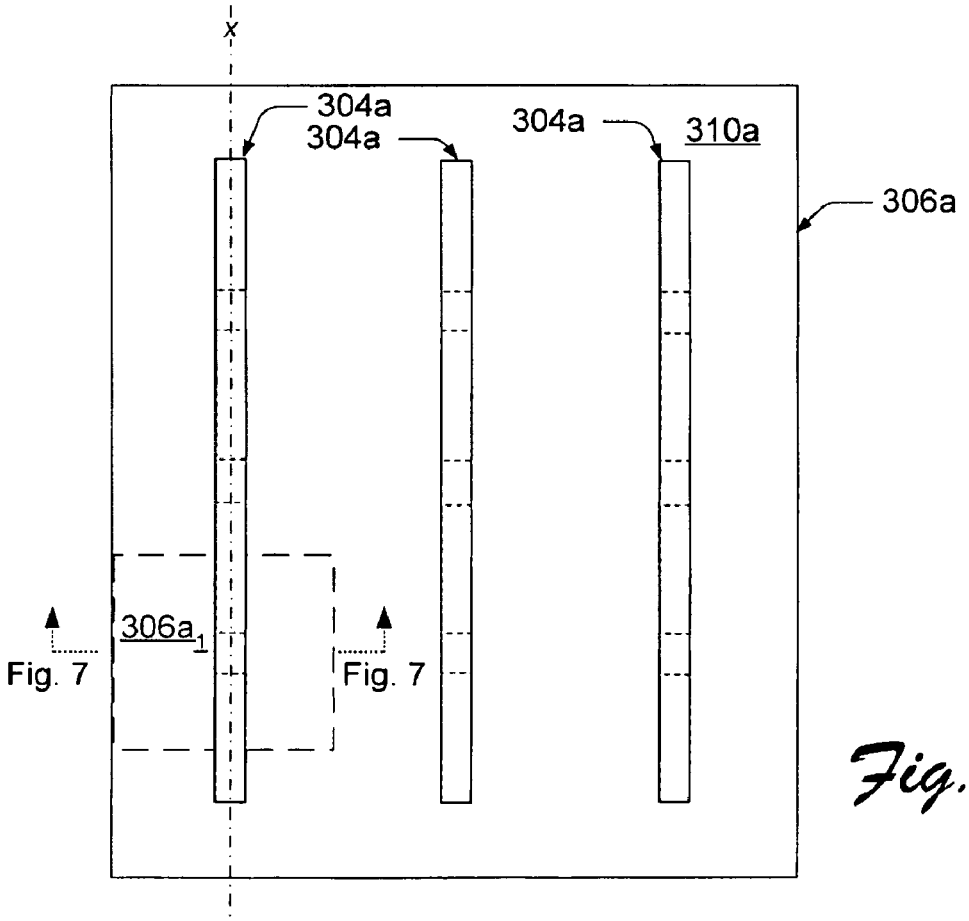
FIG. 4 shows a top view of an exemplary substrate in accordance with one embodiment.

FIG. 4 shows a view from above a first surface 310*a* of a substrate 306*a*. Three fluid-feed slots 304*a* are shown. Each fluid-feed slot extends along a long axis, an example of which is labeled "x". In this embodiment, the three fluid-feed slots 304*a* can be termed compound slots, as will be explained below in relation to FIGS. 5-8*a* that show various views of an expanded portion 306*a*, of the substrate 306*a* as shown in FIG. 4.

Figure 5:
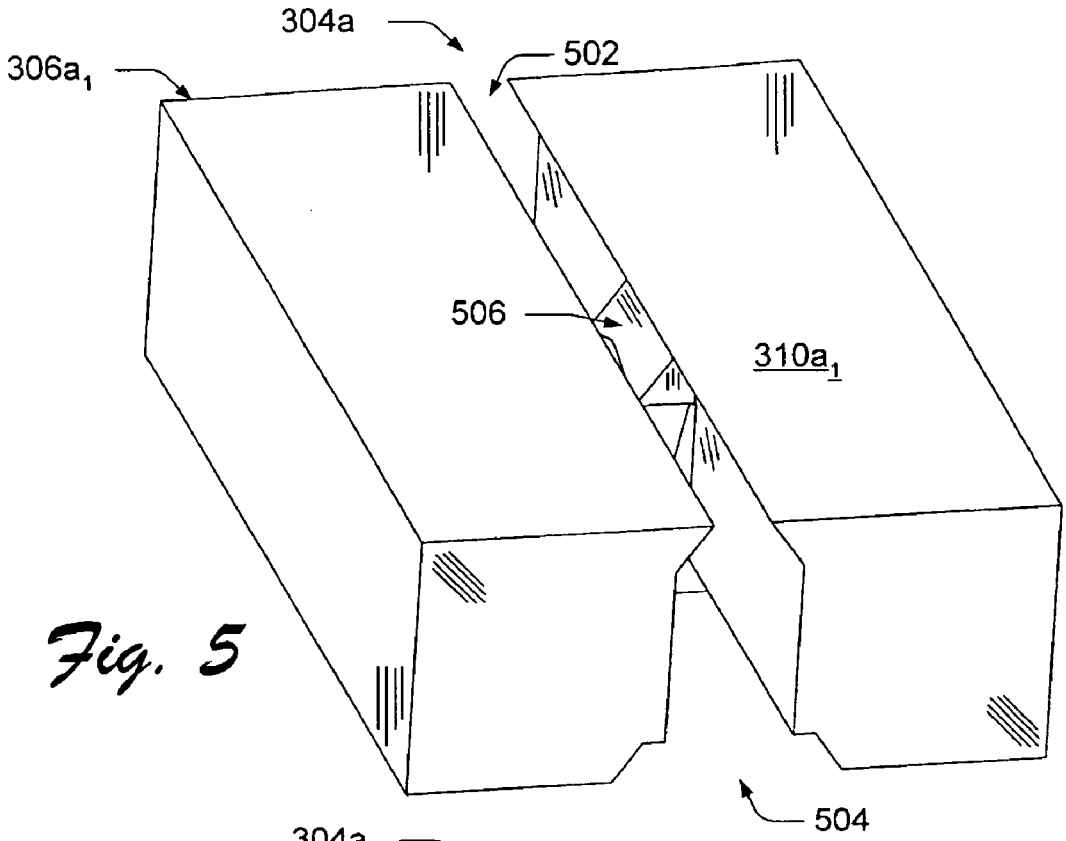
FIGS. 5-6 show perspective views of an exemplary substrate in accordance with one embodiment.
Figure 6:
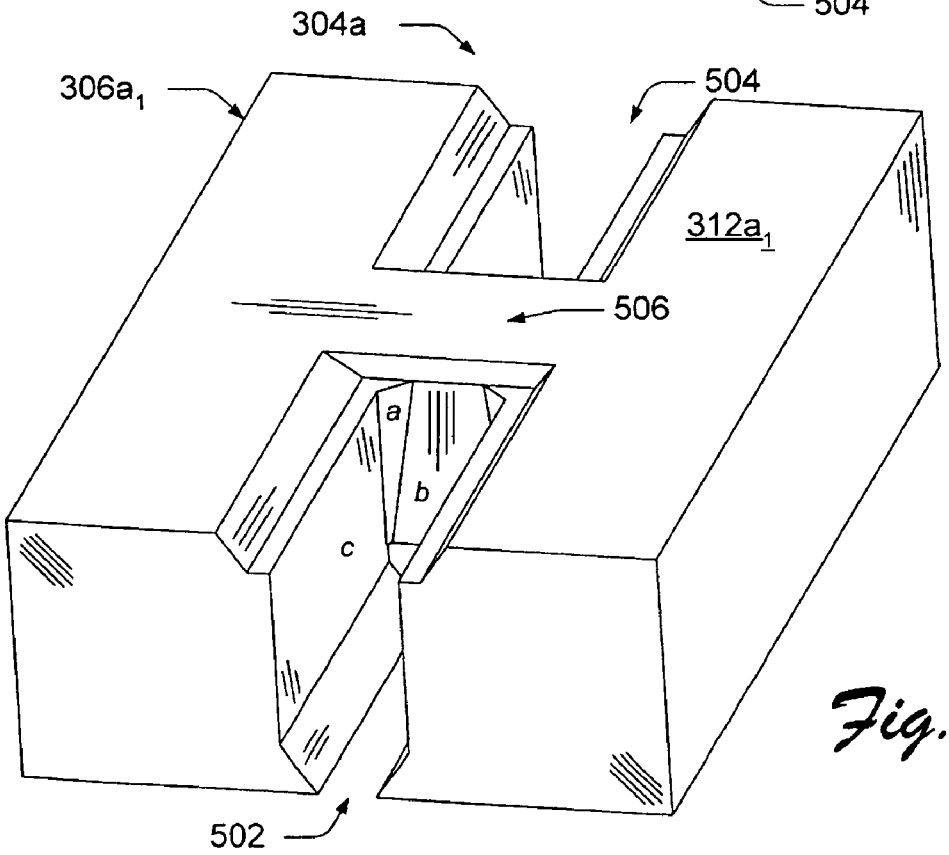

FIGS. 5 and 6 show perspective views of substrate portion 306$a_1$. FIG. 5 shows a perspective view from slightly above a first surface 310$a_1$, and FIG. 6 shows a perspective view from slightly above a second surface 312$a_1$. Slot 304*a*, a portion of which is shown here, is a compound slot since it is comprised, at least in part, by a trench 502 formed in the first surface 310$a_1$, of the substrate 306$a_1$, and connected to multiple slots 504. Slot(s) 504, as referred to herein, may comprise slots, slot portions and/or vias. Individual slots 504 can pass through the substrate from the substrate's backside 312*a* and connect with the trench 502.

In this embodiment, the trench 502 can have essentially the same length as the compound slot 304*a* as shown in FIG. 4, while the slots 504 can be shorter. Adjacent slots 504 can be separated from one another by substrate material. Such substrate material can comprise a reinforcement structure 506 that can provide characteristics to the slotted substrate as will be discussed in more detail below.

In some embodiments, the compound slots can be defined, at least in part, by a generally planar surface that intersects two or more other generally planar surfaces of the compound slot. For example, FIG. 6 shows a surface 'a' positioned between and intersecting with surfaces 'b' and 'c' of compound slot 304*a*. Other embodiments may have other configurations. For example, some embodiments can have a more rounded configuration that lacks definitive intersections of various surfaces comprising a compound slot.

Exemplary compound slots can have various suitable configurations. In one example, a compound slot can have a length of about 23,000 microns and can be comprised of a trench of similar length. The compound slot can also be comprised of one or more reinforcement structures. In one exemplary embodiment, the compound slot has six reinforcement structures each of which has a length of about 600 microns while adjacent reinforcement structures are separated by slots of about 2600 microns. In this embodiment, the slots can pass through about 90 percent of the substrate's thickness while the trench can pass through about 10 percent. In various embodiments, the depth of the trench can range from less than 50 microns to more than 400 microns among others.

Figure 7:
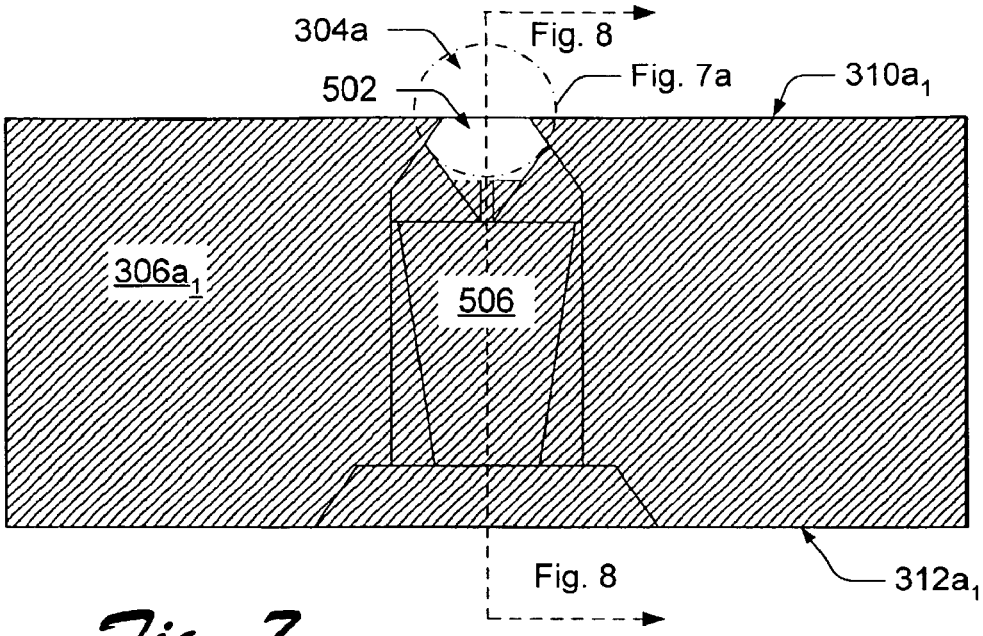
FIGS. 7, 7*a* and FIGS. 8, 8*a* and 8*b* each show a cross-sectional view of a substrate in accordance with one exemplary embodiment.

FIG. 7 shows a cross-sectional view taken transverse a long axis x of the compound slot 304*a* as shown in FIG. 4. In this view, the compound slot 304*a* is extending into and out of the page. In the cross-section shown here, a trench 502 can be seen proximate a first surface 310$a_1$, while substrate material in the form of the reinforcement structure 506 extends across the compound slot to connect substrate material on opposite sides of the compound slot.

Figure 7A:
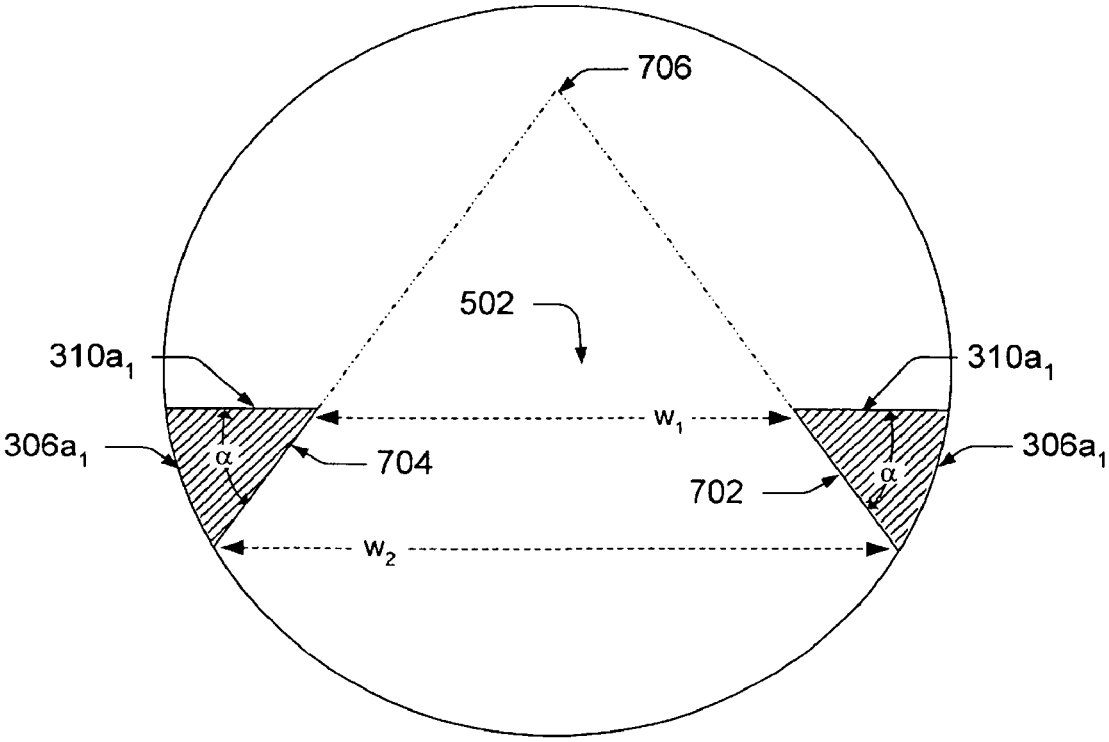

FIG. 7*a* shows an expanded view of a portion of the substrate 306$a_1$ shown in FIG. 7. FIG. 7*a* shows the trench 502 being defined, at least in part, by two sidewalls 702 and 704. The two sidewalls can lie at an angle $\alpha$ of less than 90 degrees and greater than about 10 degrees relative to the first surface 310$a_1$. In one embodiment, the sidewalls can lie at an angle $\alpha$ of about 54 degrees.

In the embodiment shown here, a v-shaped portion, shown generally at 706, can at least in part, define the trench 502. As shown here, the two sidewalls 702 and 704 comprise at least a portion of the v-shape 706.

The trench 502 can further comprise a first width $w_1$ that is proximate the first surface 310*a*, and that is less than a second width $w_2$ which is more distal to the first surface. In this embodiment, the first and second widths are defined relative to the first and second sidewalls 702 and 704, though such need not be the case.

Figure 8:
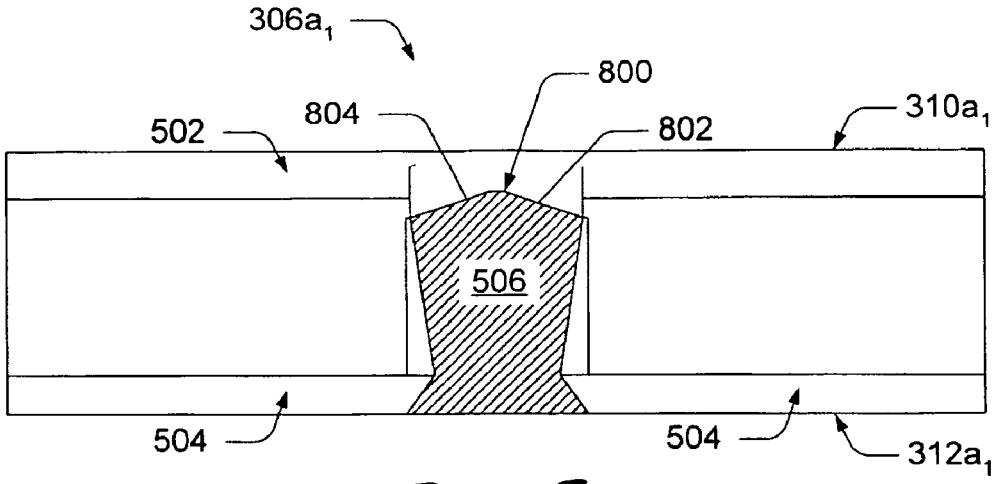
Figure 8A:
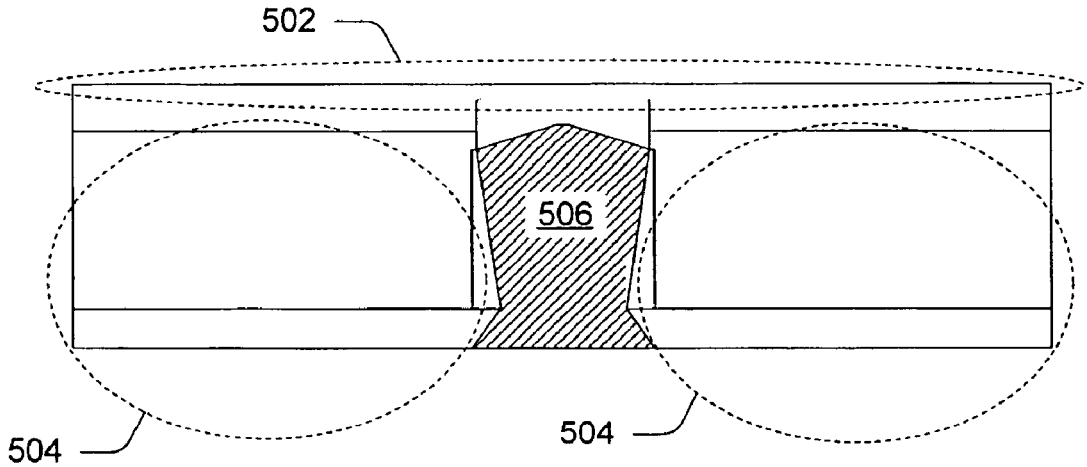

FIG. 8 shows a cross-sectional view as indicated in FIG. 7. This cross-section is taken along the long axis x of the compound slot 304*a* as indicated in FIG. 4. FIG. 8 shows a trench 502 running generally continuously along the first surface 310*a* while two slots 504 that are more proximate the second surface 312*a*, are separated by substrate material comprising a reinforcing structure 506. This may be more clearly seen in FIG. 8*a* which shows the same embodiment as FIG. 8 and aids in illustrating the respective regions for the reader.

Returning now to FIG. 8, the reinforcement structure 506 can in some embodiments, have a terminus 800 proximate the first surface $310a_1$ that can comprise two differently angled walls. For example, walls 802 and 804 are shown in FIG. 8 and have different angles relative to the first surface. In some embodiments, the angled walls can be formed along [111] planes of the substrate.

In this embodiment, the two angled walls can also form a portion of a triangle. This can be more clearly seen in FIG. 8*b* that shows an expanded view of a portion of the substrate 306*a*, in a little more detail. In this example, the reinforcement structure's two angled walls 802 and 804 form a portion of a triangle 806 shown in dashed lines. In this embodiment, the triangle comprises an isosceles triangle, though such need not be the case. Other embodiments can have a terminus 800 comprising more angled walls. For example, in some embodiments, the terminus can comprise four angled walls that form at least a portion of a pyramid shape.

Figure 8B:
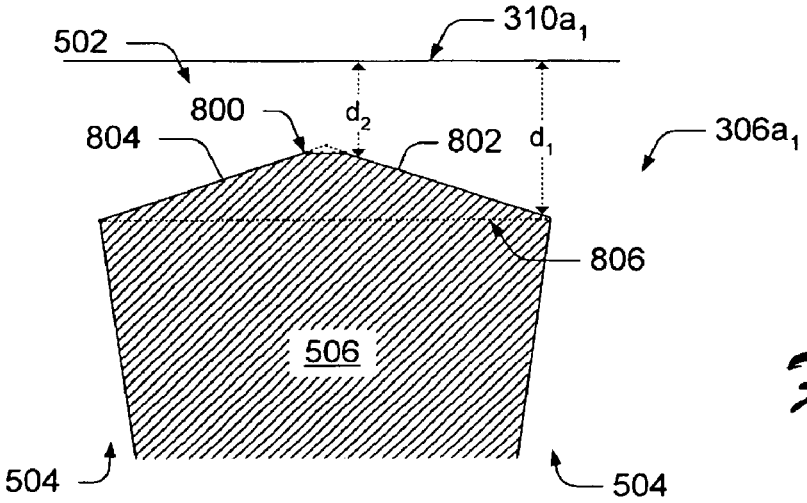

The shape of the reinforcement structure's terminus can allow a compound slot's trench to be deeper at regions proximate a slot 504 than at regions more distant to the slot 504. For example, FIG. 8*b* shows a depth $d_1$ of the trench 502 proximate a slot 504 while a second depth $d_2$ is more distant the slot. The depth $d_1$ is greater than the depth $d_1$. The increasing depth of the trench proximate a slot can, among other factors, reduce bubble accumulation in the compound slot in some embodiments.

Bubbles can, among other origins, be formed in the ink as a byproduct of the ejection process when a slotted substrate supplies fluid that is ultimately ejected from an ejection chamber through a firing nozzle (described in relation to FIG. 3). If the bubbles accumulate in the fluid-feed slot they can occlude ink flow to some or all of the ejection chambers and cause a malfunction.

In some of the described embodiments, the slotted substrate can be oriented in a printing device so that the first surface is proximate the print media. Ink can then flow generally from the print cartridge body through the second surface or backside, toward the thin film surface, where it can ultimately be ejected from the nozzles. Bubbles can travel in a direction generally opposite to the ink flow. The described embodiments can increase the propensity of bubbles to migrate as desired. For example, as shown in FIG. 8*b*, the increasing depth of the trench 502 can allow bubbles to migrate toward a slot 504 where they can migrate generally away from the first surface $310a_1$ into the slot 504 and ultimately out of the substrate $306a_1$.

The described slotted substrate comprising compound slots can be much stronger than previous designs. Consider FIG. 9 which shows a traditional slotted substrate, and FIG. 10 which shows an exemplary slotted substrate with compound slots.

Figure 9:
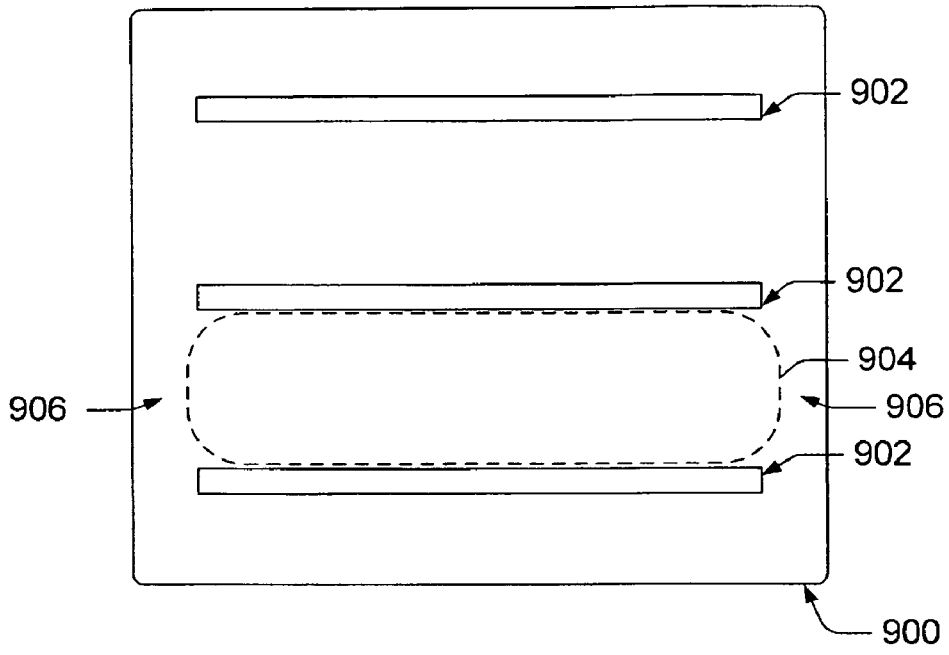
FIG. 9 shows a top view of a substrate.

FIG. 9 shows a substrate 900 that has three slots 902 formed therein. Almost all substrate material is removed within individual slots 902 so that adjacent slots are separated by substrate material that is supported solely between respective adjacent slot ends. This substrate material is often referred to as a "beam", an example of which is shown generally at 904. Such beams 904 tend to deform relative to the substrate material at the ends of the substrate 900, an example of which is shown generally here at 906. This can be especially problematic as slots 902 are positioned closer together to achieve a smaller print head.

A beam 904 can often distort, bend and/or buckle from the generally planar configuration that the substrate 900 can have prior to slot formation. Such distortion can be the result of torsional forces, among others, experienced by the substrate when integrated into a print head. For example, torsional forces can be measured by a resistance of the slotted substrate to deviance from an ideal configuration relative to an axis that is parallel to a long axis of the substrate. The long axis of the substrate being generally parallel to the long axis of the slots. The distortion or deformation can make the substrate weaker and more prone to breakage during processing.

Distortion and/or deformation can also make integrating the substrate into a die or other fluid ejecting device more difficult. Often the substrate is bonded to other different substrates to form a print head and ultimately a print cartridge. These different substrates can be stiffer than a slotted substrate produced by existing technologies and can cause the slotted substrate to deform to their configuration. The distortion of the print head can change the geometries at which fluid is ejected from the ejection chambers located on the distorted portions of the slotted substrate.

Figure 10:
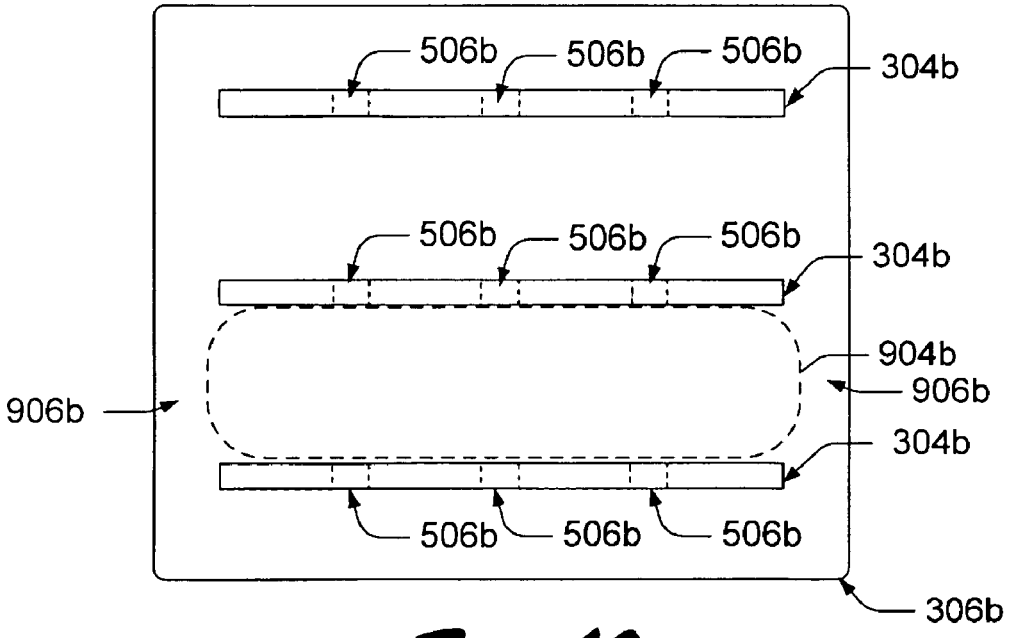
FIG. 10 shows a top view of an exemplary substrate in accordance with one embodiment.

The exemplary slotted substrates are more resistant to such deformation, and can better maintain the planar configuration that is desired in many print heads. This can be seen by comparing the exemplary slotted substrate 306*b* shown in FIG. 10 to the slotted substrate shown in FIG. 9. FIG. 10 shows the substrate 306*b* with three compound slots 304*b* formed therein. The compound slots have reinforcement structures 506*b* positioned intermittently along their length.

The reinforcement structures 506*b* can, among other things, serve to connect or strengthen the substrate material on opposite sides of a compound slot 304*b*. The reinforcement structures can support the substrate material or beam along its longitudinal side between adjacent compound slots. One such beam is shown here generally at 904*b*. The reinforcement structures can support the beam and reduce the propensity of the beam to deform relative to the substrate material 906*b* at the slot ends. This can be especially advantageous in embodiments where slot length is increased and/or the distance between slots is decreased. When a traditional slot is lengthened the tendencies of the beam(s) to deform is magnified, whereas with the exemplary compound slots, more reinforcement structures can be provided as the slot length is increased to maintain substrate continuity.

Exemplary Methods

FIGS. 11, 11*a* and 11*b*-FIGS. 12, 12*a* and 12*b* illustrate process steps of an exemplary method for forming compound slots in a substrate in accordance with some implementations. In one such implementation, a substrate can comprise, at least in part, a print head wafer.

Figure 11:
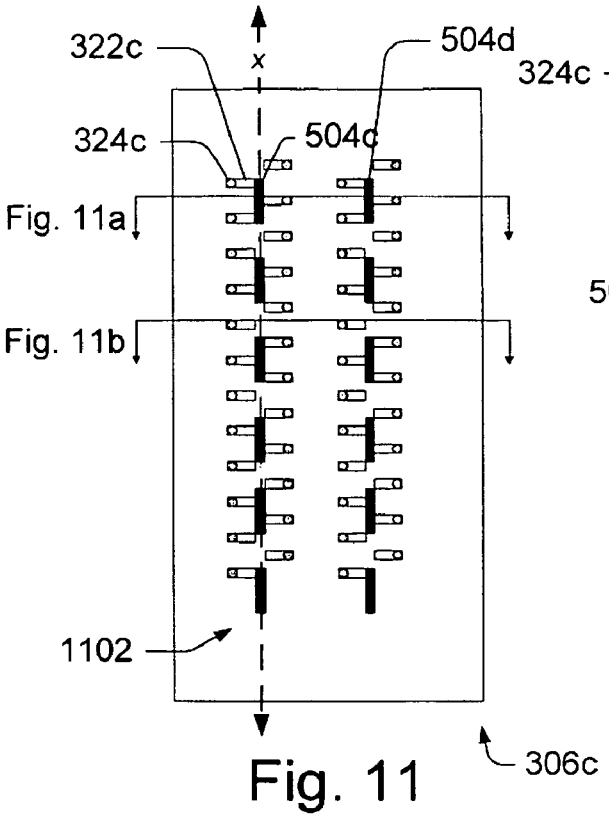
FIGS. 11 and 12 show top views of process steps of an exemplary substrate in accordance with one embodiment.
Figure 11A:
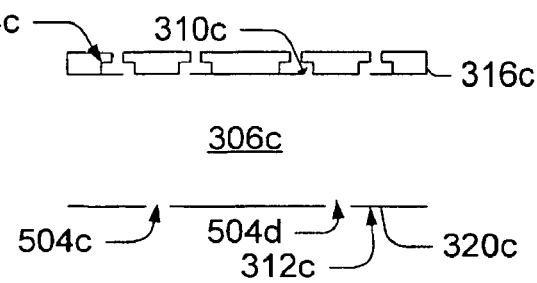
FIGS. 11*a-b* and FIGS. 12*a-b* show cross-sectional views of process steps of an exemplary substrate in accordance with one embodiment.
Figure 11B:
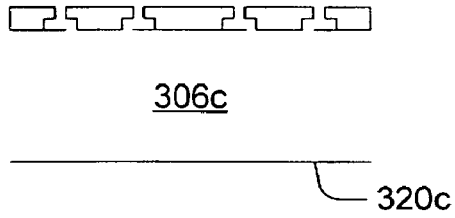

FIG. 11 shows a view from above the substrate 306*c*, while FIGS. 11*a*-11*b* show two different cross-sectional views through the substrate as indicated in FIG. 11. As can best be seen in FIG. 11*a*, the substrate 306*c* has a first surface 310*c* and second generally opposing surface 312*c*.

Some of the suitable implementations can allow various layers, such as thin-film layers, to be positioned and/or patterned over either or both of the first and second surfaces before forming the one or more compound slot(s) (304*c* and 304*d* shown FIG. 12) in the substrate. In this implementation, multiple thin-film layers, including a barrier layer 316*c*, have been positioned over the substrate's first surface 310*c* to form firing chambers 324*c* and associated structures, such as fluid-feed passageway 322*c*, as described above. As such, in this implementation, the first surface 310*c* can be referred to as the thin-film surface. Additionally, in this implementation, a hard mask layer 320*c* has been patterned over the substrate's second surface 312*c*, which in this implementation can be referred to as the backside surface.

A plurality of slots 504*c* and 504*d* can be formed into the substrate 306*c* as shown generally at 1102. For example, FIG. 11*a* shows a cross-sectional view where two slots 504*c* and 504*d* were formed through the substrate 306*c*, while FIG. 11*b* shows a cross-sectional view of the substrate where no slots were formed. As shown in FIGS. 11 and 11*a*, two distinct sets of slots 504*c* and 504*d* have been formed for two respective compound slots (304*c* and 304*d* shown FIG. 12).

In this implementation, the slots 504*c-d* are formed in the second surface 312*c* where the second surface comprises a backside surface. In this implementation, the slots are spaced generally evenly along a long axis of an individual compound slot. For example, one such long axis 'x' is shown in FIG. 11. In other implementations, a plurality of slots can be formed at varying distance from one another and/or be positioned offset from a long axis. Further, as shown here, the slots are bisected by the compound slot's long axis, though such may not be the case. For example, in other embodiments, the slots can be offset from the long axis.

The slots 504*c-d* can be formed utilizing any suitable technique. For example, in one implementation, the slots are formed utilizing laser machining. Various suitable laser machines will be recognized by one of skill in the art. For example, one suitable laser machine that is commercially available can comprise the Xise 200 laser Machining Tool, manufactured by Xsil ltd. of Dublin, Ireland.

Other suitable techniques for forming the slots, such as 504*c-d*, can include etching, sand drilling, and mechanical drilling, among others. In one implementation utilizing etching, areas of the backside hard mask can be patterned to control the areas through which slots are formed. Alternating acts of etching and passivating can form slots into the substrate. In some embodiments, such alternating acts of etching and passivating can comprise dry etching. Such an etching technique, among others, can form individual slots having an anisotropic slot profile. An example of such an anisotropic slot profile can be seen with slots 504*c-d* in FIG. 11*a*.

Sand drilling is a mechanical cutting process where target material is removed by particles, such as aluminum oxide, delivered from a high-pressure airflow system. Sand drilling is also referred to as sand blasting, abrasive sand machining, and sand abrasion. Mechanical machining can include the use of various saws and drills that are suitable for removing substrate material. Alternatively or additionally, to forming the slots utilizing a single technique, various removal techniques can be advantageously combined to form the slots.

Figure 12:
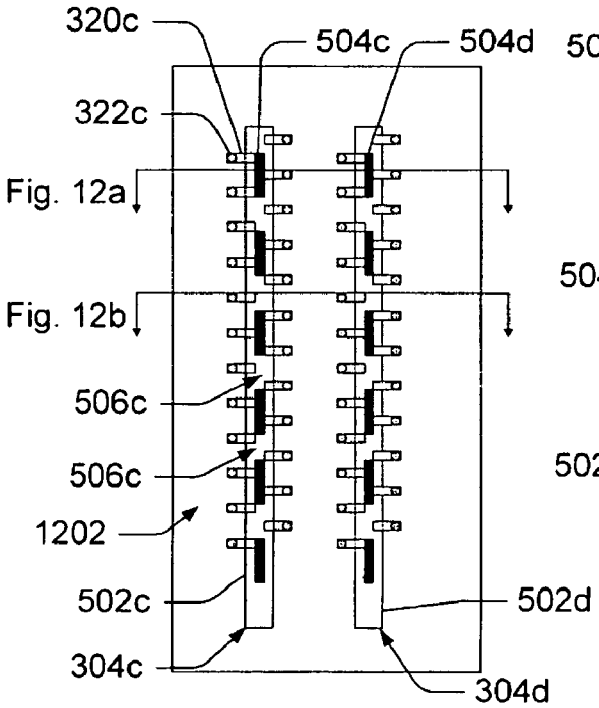
Figure 12A:
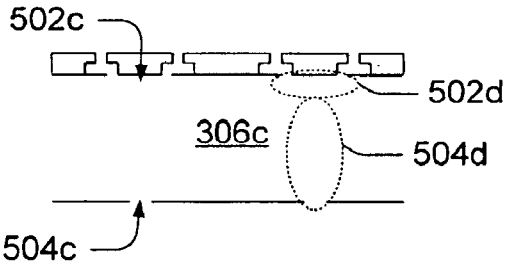
Figure 12B:
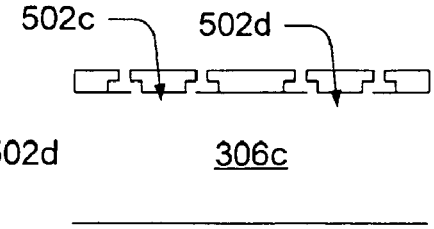

In FIGS. 12, 12*a* and 12*b* a trench is formed in the substrate 306*c* as shown generally at 1202. In some implementations, the trench is contiguous with the plurality of slots, such as 504*c* (as described with respect to FIG. 11), to form a compound slot 304*c*. As shown here, two trenches are formed, each trench having an inverted v-shape when viewed in transverse cross-section. Trench 502*c* is contiguous with slots 504*c* and trench 502*d* is contiguous with slots 504*d*. To aid the reader, FIG. 12*a* indicates trench 502*c* and slot 504*c* generally with arrows, while the respective areas of trench 502*d* and slot 504*d* are generally shown within a dashed line.

In some implementations, forming a trench comprises etching a trench. In one such implementation, the first and second surfaces of the substrate can be exposed to an etchant sufficient to remove substrate material to form a trench contiguous with the plurality of slots to form a compound slot. An example of which can be seen in relation to FIGS. 12, 12*a* and 12*b* where compound slots 304*c* and 304*d* were formed from slots 504*c* and trench 502*c*, and slots 504*d* and trench 502*d*, respectively. Alternatively or additionally, to controlling trench shape, the shape of individual slots comprising a finished compound slots can be controlled, in some embodiments, by patterning a backside mask in relation to a desired slot profile as will be discussed in more detail below.

In embodiments utilizing an etchant to form the trench, any suitable etchant can be utilized. For example, in one implementation, TMAH (Tetramethylammonium Hydroxide) can be utilized. Such a process can form a compound slot while retaining substrate material comprising a trench while retaining at least one reinforcement structure, such as reinforcement structure 506*c* shown in FIG. 12. In some embodiments where an etchant is used to form the trench, some or all of the thin-film layers positioned over the first surface, such as 310*c*, can be patterned to define the trench dimensions at the first surface. Alternatively or additionally, in some implementations, the shape of individual slots comprising a compound slot can be controlled by patterning a backside mask in a desired ratio to the dimensions of a given slot portion.

For example, in the embodiment shown in FIGS. 11, 11*a* and 11*b* through 12, 12*a* and 12*b*, the finished slots 504*c* and 504*d* are formed with a re-entrant profile when viewed in cross-section as seen in FIG. 12*a*. Other embodiments can have slots with a different cross-sectional view. For example, FIGS. 5-7 show an embodiment where the widest portion of an individual slot, when viewed in transverse cross-section, such as is shown in FIG. 7, is proximate the second surface 312*a*$_1$.

The configuration of the slots can be controlled by, among other ways, patterning a backside mask to control etching during the trench formation process. For example, one way of achieving the profile shown in FIG. 12*a* is to pattern the backside mask the same width as the individual slots. For example, FIG. 11*a* shows a patterned backside masking layer 320*c* that is the generally the same width as the slots 504*c* and 504*d*.

The masking layer can limit etching of the backside layer during the trench formation process to produce the re-entrant slot profile shown in for slot 504*c* in FIG. 12*a*. One way of achieving a configuration with a wider slot profile proximate the backside surface, such as shown in FIGS. 5-7, is to pattern a backside hard mask to leave a desired area of the backside surface exposed to the etchant while removing additional substrate material to form a trench and hence a compound slot.

Desired geometries of the respective features can be controlled by, among other factors, an amount of time that the substrate, such as 306*c*, is exposed to the etchant. For example, in one embodiment, etching can be stopped when substrate material is removed along <111> planes sufficient to form a reinforcement structure's terminus as described above.

Forming the trench, such as 502*c*, by exposing the substrate to an etchant can remove sharp and/or rough substrate material that could otherwise serve as crack initiation sites. The etching process can also smooth out surfaces of the compound slot(s), such as 304*c*, allowing for more efficient ink flow.

The exemplary embodiments described so far have comprised removal steps to remove substrate material to form the compound slots. However, other exemplary embodiments can include various steps where material is added to the substrate during the slotting process. For example, in one embodiment, after the slots are formed, a deposition step can add a new layer of material through which the trench is formed to form the compound slot. Other embodiments can also include one or more steps to clean-up or further finish the compound slots. These additional steps can occur intermediate to, or subsequent to, the described steps.

Conclusion

The described embodiments can provide methods and systems for forming a fluid-feed slot in a substrate. The fluid-feed slots can supply ink to the various fluid ejecting elements connected to the fluid-feed slot while allowing the slotted substrate to be stronger than existing technologies. The described fluid-feed slots can have a compound configuration comprised of a trench received in the substrate's first surface and connected to a plurality of slots passing through the substrate from its second surface. The described embodiments leave substrate material between the various slots comprising the plurality of slots and therefore enhance the structural integrity of the slotted substrate. This can be especially valuable for longer slots that can otherwise tend to cause the substrate to be brittle and have a propensity to deform. The described embodiments are scalable to allow a compound fluid-feed slot of almost any desired length to be formed. The compound slots can have beneficial strength characteristics that can reduce die fragility and allow slots to be positioned closer together on the die, while reducing potential occlusion of the ink feed slot(s).

Although the invention has been described in language specific to structural features and methodological steps, it is to be understood that the invention defined in the appended claims is not necessarily limited to the specific features or steps described. Rather, the specific features and steps are disclosed as preferred forms of implementing the claimed invention.

What is claimed is:

1. A structure comprising:

a substrate having a compound slot formed between a first surface and a generally opposing second surface, the compound slot extending along a long axis and being defined at least in part by a plurality of reinforcement structures composed of substrate material which extends across the compound slot to connect substrate material on opposite sides of the compound slot.

2. The structure of claim 1, wherein the compound slot has a length of at least 23,000 microns.

3. The structure of claim 1, wherein the compound slot is comprised of at least five reinforcement structures.

4. The structure of claim 3, wherein a length of each reinforcement structure is at least 600 microns.

5. The structure of claim 1, wherein the structure has a trench proximate the first surface.

6. The structure of claim 1, wherein each reinforcement structure has a terminus proximate the first surface that comprises two differently angled walls relative to the first surface.

7. The structure of claim 6, wherein the terminus forms a point.

8. The structure of claim 6, wherein the two differently angled sidewalls of the terminus form a line.

9. The structure of claim 6, wherein the terminus approximates a triangle.

10. The structure of claim 9, wherein the triangle is an isosceles triangle.

11. The structure of claim 1, wherein each reinforcement structure has a terminus proximate the first surface that comprises two equal-angled walls relative to the first surface.

12. The structure of claim 1, wherein each reinforcement structure has a terminus proximate the first surface that comprises two angled walls relative to the first surface that form a portion of a triangle.

13. The structure of claim 1, wherein each reinforcement structure has a terminus proximate the first surface that comprises four angled walls relative to the first surface that form at least a portion of a pyramid shape.

14. The structure of claim 1, wherein the structure has a trench proximate the first surface and wherein each reinforcement structure has a terminus proximate the first surface, a shape of the reinforcement structure's terminus allowing a compound slot's trench to be deeper at regions proximate a slot in the compound slot than at regions more distant to the slot.

15. The structure of claim 14, wherein a depth D1 of the trench is proximate a slot and a second depth D2 of the trench is more distant the slot, the depth D1 being greater than the depth D2.

16. The structure of claim 1, wherein the structure has a trench proximate the first surface and wherein each reinforcement structure has a terminus proximate the first surface, a shape of the reinforcement structure's terminus allowing a compound slot's trench to be deeper at regions proximate an individual slot in the compound slot than at regions more distant to the individual slot, the individual slot passing through the substrate and connecting with the trench.

17. The structure of claim 1 having a plurality of compound slots formed therein, where each compound slots has reinforcement structures positioned intermittently along its length.

18. The structure of claim 1 wherein the compound slot comprises an elongate trench portion that extends along a long axis.

19. A structure comprising:

a substrate having a slot formed between a first surface and a generally opposing second surface, the slot extending along a long axis and being defined at least in part by at least one reinforcement surface which extends across the slot generally orthogonally to the long axis and wherein the at least one reinforcement structure is defined, at least in part, by a proximate portion the first surface which approximates a portion of a triangle.

* * * * *